US005328726A

United States Patent [19]

Reiter

[11] Patent Number: 5,328,726

[45] Date of Patent: Jul. 12, 1994

[54] CURTAIN COATING METHOD AND APPARATUS USING DUAL WIRE EDGE GUIDES

[75] Inventor: Thomas C. Reiter, Hilton, N.Y.

[73] Assignee: Eastman Kodak Company, Rochester, N.Y.

[21] Appl. No.: 979,504

[22] Filed: Nov. 19, 1992

[51] Int. Cl.[5] ..... B05D 1/30; B05C 5/00

[52] U.S. Cl. ..... 427/420; 118/324; 118/DIG. 4

[58] Field of Search ..... 427/420; 118/DIG. 4, 118/324

[56] References Cited

U.S. PATENT DOCUMENTS

| | | | |
|---|---|---|---|
| 3,365,325 | 1/1968 | Fraenkel et al. . | |
| 3,632,374 | 1/1972 | Greiller | 118/324 |
| 3,717,121 | 2/1973 | Bruckbauer et al. . | |
| 4,479,987 | 10/1984 | Koepke | 118/DIG. 4 |
| 4,830,887 | 5/1989 | Reiter | 427/420 |
| 5,017,408 | 5/1991 | Kozak | 427/420 |

OTHER PUBLICATIONS

Journal of Colloid and Interface Sciences, "A New Method of Measuring Dynamic Surface Tension", pp. 583-585, vol. 77, No. 2, Oct., 1980.

*Primary Examiner*—Shrive Beck
*Assistant Examiner*—Katherine A. Bareford
*Attorney, Agent, or Firm*—Carl F. Ruoff

[57] ABSTRACT

The present invention discloses edge guides (12) for use in guiding a curtain (17) of coating liquid onto a moving support. Each edge guide (12) is made of two or more small diameter wires (20) spaced apart a distance and running from the hopper lip (16) to the support web. The distance between the wires is approximately the thickness of the curtain. Flushing solution is introduced between the wires (20) near the hopper lip (16) and removed near the support web (15).

25 Claims, 4 Drawing Sheets

FIG. 2
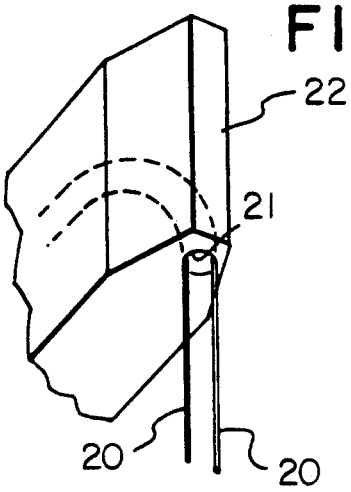
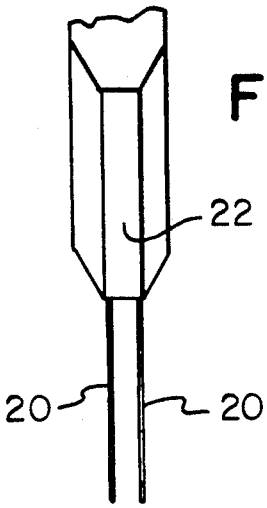
FIG. 3
FIG. 4
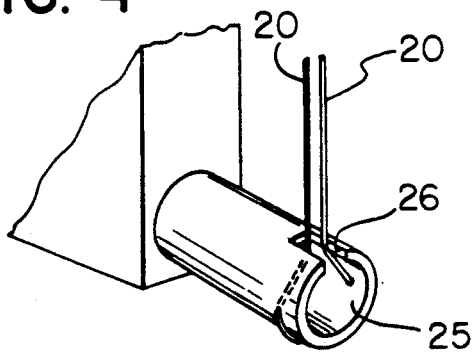
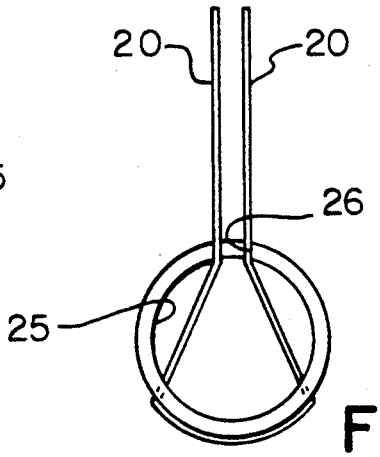
FIG. 5

FIG. 7
(PRIOR ART)
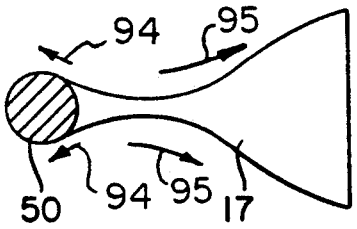
FIG. 8
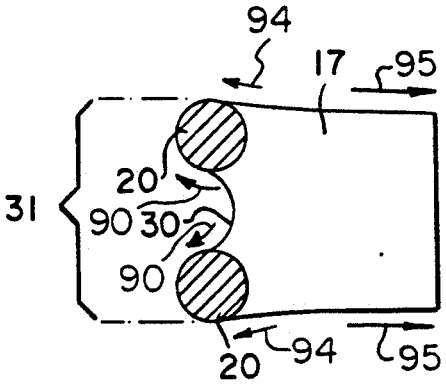
FIG. 9
(PRIOR ART)
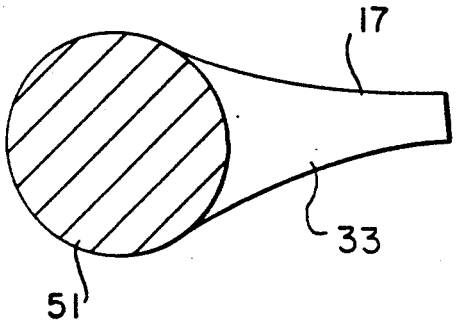
FIG. 10
(PRIOR ART)
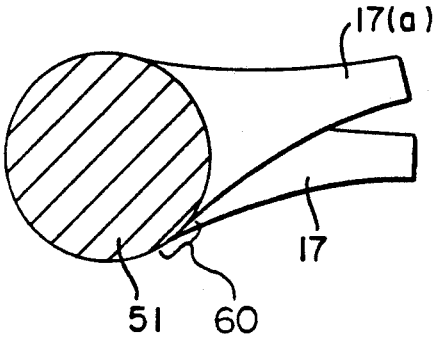
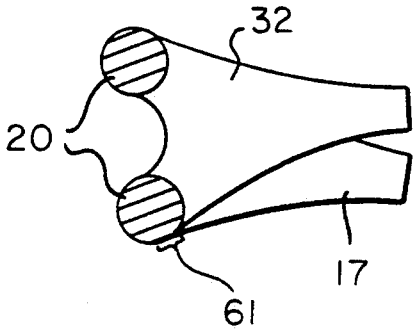
FIG. 11

CURTAIN COATING METHOD AND APPARATUS USING DUAL WIRE EDGE GUIDES

FIELD OF THE INVENTION

The present invention relates to a method and apparatus for coating objects or moving supports advancing continuously through a coating station with a free falling curtain of coating liquid. More particularly, the present invention relates to a curtain coating method and apparatus for the manufacture of photographic film and paper.

BACKGROUND OF THE INVENTION

In a coating station of the curtain coating type a moving support is coated by causing a free falling curtain of coating liquid to impinge onto the moving support to form a layer thereon. An apparatus to perform this method is described in U.S. Pat. No. 3,508,947 to Hughes wherein a multilayer composite of a plurality of distinct layers is formed on a slide hopper and dropped therefrom to form a free falling curtain.

In the curtain coating process, particularly as used to manufacture multilayer photographic materials, the quality of the coating is largely determined by the properties of the liquid curtain. It is important to ensure that a stable laminar liquid sheet is formed by the slide hopper and that an equally stable, laminar flow, liquid curtain is formed from that sheet. To prevent contraction of the falling curtain under the effect of surface tension, it is known that the curtain must be guided at its edges by curtain edge guides.

In general, edge guides are stationary, solid members which are attached to the slide hopper used to supply coating liquid to the curtain and extend downwardly from the initial point of free fall of the curtain, the so called hopper lip. Wetting contact of the edges of the falling curtain with the edge guides should be maintained along the entire length of the edge guides to avoid a break in the curtain.

Curtain stability is commonly defined by the speed at which a disturbance (wave) moves through a curtain relative to the curtain. If the curtain speed is greater than the wavespeed, the disturbance is washed downstream and the curtain is stable. If the curtain speed is less than the wavespeed, then the disturbance propagates upstream and the curtain is unstable. The wavespeed disturbance is given by:

$$C=(2*\delta*U/(\rho*Q))^{\frac{1}{2}} \quad (1)$$

Where:

C=Wavespeed of a disturbance $\delta$=Local surface tension

U=Local curtain speed $\rho$=Density

Q=Volumetric flowrate per unit width (See Journal of Colliod and Interface Sciences, Vol. 77, No 2, October 1980, pp. 583-585).

Using the curtain stability criteria that the curtain speed must be greater than the wavespeed:

$$U>C \quad (2)$$

The curtain stability criterion can be rearranged to read:

$$\rho*Q*U/2*\delta>1 \quad (3)$$

It is clear from equation 3 that the local curtain speed and the volumetric flowrate per unit width, referred to herein as flowrate, are the dominant factors in determining curtain stability, since the density and local surface tension only vary by small amounts.

Equation 3 shows that a lower flowrate yields a less stable curtain. In particular, the flowrate within approximately 0.5 cm of the edge guide typically determines curtain stability, since this region is where the flowrate nonuniformity caused by edging equipment occurs. Therefore, to maximize curtain stability, an edge guide should not adversely affect the thickness uniformity near the curtain edge.

Equation 3 also shows that the curtain stability increases as the local curtain speed increases. Again, the curtain edge typically has the lowest speed since this region experiences the effect of viscous drag forces with the edge wall. Therefore, an edging system which minimizes viscous drag forces will exhibit a more stable curtain.

Lower drag forces have been effectively achieved in the prior art through use of a low viscosity flushing solution to prevent the higher viscosity curtain solution from contacting the edge guide. Another method for reducing the drag forces is to reduce the edge guide-curtain contact area. This has been attempted in the prior art by employing a small diameter edge guide, typically a wire or rod. However, poor curtain stability was observed. Perhaps this is best explained by a force balance analysis at the curtain edge. Surface tension forces attempt to contract the curtain surfaces, and the edge guide is attempting to overcome this contractile force to maintain a constant curtain width. Prior art designs which have been successful have relied upon a relatively large edge guide contact land and the resultant meniscus formed by that land to balance the curtain contractile force. When the contact land width is reduced, an imbalance is observed and the curtain is unstable.

Since edge guides are typically solid members, there is always the possibility of photographic material congealing on the edge guide surface. This is particularly true when there is a stagnant fluid region. Such stagnant fluid regions can occur in the prior art when the curtain moves backward and forward under the influence of pressure differences between the frontside and backside of the curtain. As the curtain moves to and fro, liquid deposits are left on the edge which may eventually congeal. The formation of congealed deposits on the edge guide may act as a disturbance source in the curtain and result in a thickness nonuniformity in the final coating, or produce an unstable curtain.

The prior art is not successful in providing an edge guide which achieves good curtain stability and uniform thickness up to the edge guides, while reducing the propensity to form congealed deposits. Thus, efficient use of the curtain coating method for manufacturing photographic materials has been adversely affected.

The present invention describes a method and apparatus wherein a more stable curtain is formed, the propensity to form congealed deposits is greatly reduced and there is uniform film thickness up to the edge guides.

SUMMARY OF THE INVENTION

The present invention is a method and apparatus for curtain coating a support with one or more layers of a coating liquid. The apparatus includes a conveying means for moving the support along a path through a coating zone and hopper means for forming one or more layers of coating liquid to form a free falling curtain which extends transversely through the path and impinges on the support and edge guides. The edge guides are spaced apart a distance and laterally guide the free falling curtain. Each of the edge guides comprises two or more wires spaced apart a distance, the distance being approximately equal to the thickness of the curtain, the wires extending from the hopper to the support; flushing means for issuing a flushing solution to maintain contact with the wires and an edge of the curtain; and suction means near the support for extracting the flushing solution. In a preferred embodiment, the spacing of the wires is greater near the hopper means and tapers with distance from the hopper means.

BRIEF DESCRIPTION OF THE DRAWINGS

FIG. 2 shows a magnified perspective view of the flush solution outlet used on the edge guide of the present invention.

FIG. 3 shows a magnified front view of the flush solution outlet used on the edge guide of the present invention.

FIG. 4 shows a magnified perspective view of the flush solution inlet used on the edge guide of the present invention.

FIG. 5 shows a front view of the flush solution inlet used on the edge guide of the present invention.

FIG. 7 shows a cross-sectional top view of an edge of the liquid curtain and a prior art edge guide.

FIG. 8 shows a cross-sectional top view of an edge of the liquid curtain and an edge guide of the present invention.

FIG. 9 shows a cross-sectional top view of an edge of the liquid curtain and a prior art edge guide.

FIG. 10 shows a cross-sectional top view of an edge of the liquid curtain and a prior art edge guide detailing the change of the wetting line of the edge guide under the influence of curtain motion.

FIG. 11 shows a cross-sectional top view of an edge of the liquid curtain and an edge guide of the present invention detailing the change of the wetting line of the edge guide under the influence of curtain motion.

For a better understanding of the present invention together with other objects, advantages and capabilities thereof, reference is made to the following description and appended claims in connection with the above-described drawing.

DESCRIPTION OF THE PREFERRED EMBODIMENT

The present invention describes an edging apparatus which provides increased curtain stability, reduced propensity to form congealed deposits of photographic material and improved widthwise uniformity when practicing a curtain coating operation. The edge guide of the present invention uses two small diameter wires spaced a distance apart, running from the hopper lip to the support web to guide an edge of a falling curtain. The distance between the wires is approximately the thickness of the curtain. The plane formed by the two parallel wires is oriented approximately perpendicular to the curtain plane. Flushing water is introduced between the wires near the hopper lip. When using inboard edging as described in U.S. Pat. No. 4,830,877, the water is removed near the support or web being coated. When using a curtain wider than the width of the support as described in U.S. Pat. No. 3,632,374, the flushing solution is caught in a catch pan. The method of U.S. Pat. No. 3,632,374 is referred to hereinafter as outboard edging.

Figure 1:
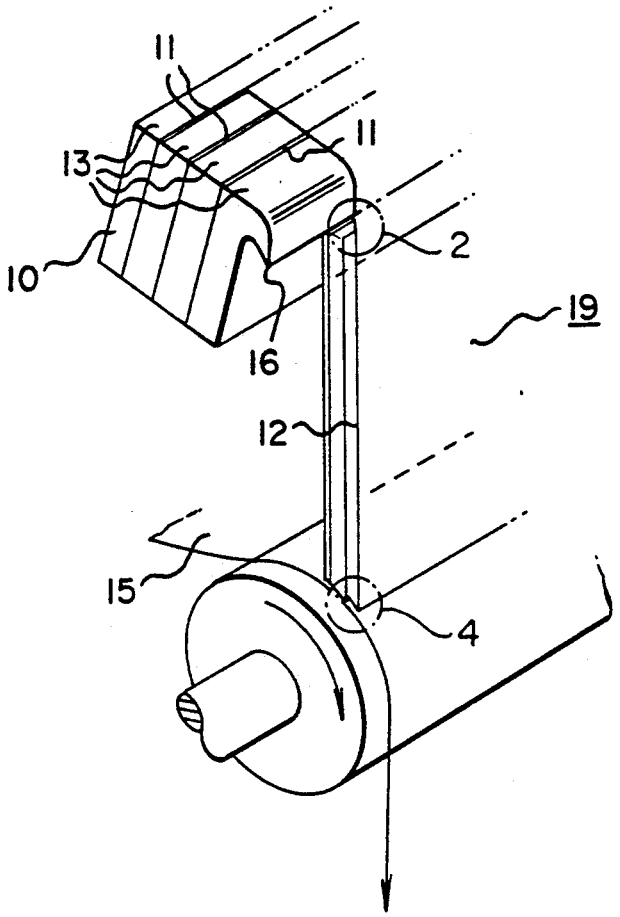
FIG. 1 shows a perspective schematic view of a curtain coating slide hopper used with one embodiment of the present invention.

The present invention relies upon matching of the curtain thickness and the spacing of the edge guide wires, and reduction of viscous drag forces which act upon the curtain fluids in the vicinity of the edge guide, thus overcoming adverse effects associated with the prior art. However, the present invention will work if the spacing between the guide wires is more than two times the curtain thickness. FIG. 1 shows a simplified perspective schematic view of one end of a curtain coating apparatus used with the edge guide of the present invention. FIG. 1 includes a slide hopper (10) having three metering slots (11) which emit coating liquid. The superimposed coating liquids flow down the slide surface (13) to the hopper lip (16). As the coating liquids leave the hopper lip (16) they form a free falling curtain (19) which is guided at one edge by edge guide (12).

FIGS. 2 and 3 show magnified perspective and front views of the flush solution outlet indicated generally by circle (2) in FIG. 1. As the curtain leaves the hopper lip it contacts the preflush land (22). After the curtain leaves the preflush land (22), the curtain meets the dual wires (20) where the flush solution is emitted from channel (21) and runs between the two wires from the top of the edge guide to the bottom of the edge guide. FIG. 3 shows a magnified front view of the top of the edge guide showing the configuration of the preflush land (22) and the dual wires (20).

FIGS. 4 and 5 show magnified perspective and front views of the flush solution evacuation outlet indicated generally by circle (4) of FIG. 1. The flush solution evacuation inlet includes port (25) and slot (26). The flush solution is withdrawn through the slot (26) by providing suction through the port (25). FIG. 5 shows a front view of the flush solution evacuation inlet. FIG. 5 shows the configuration of the dual wires (20) in relation to the slot (26).

Figure 6:
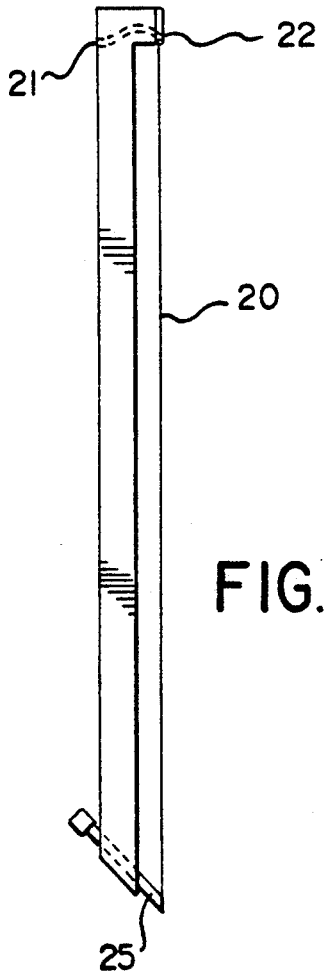
FIG. 6 shows a side view of an edge guide of the present invention.

FIG. 6 shows a side view of the edge guide of the present invention. Shown in FIG. 6 is the flush water outlet (21), the preflush land (22), dual wires (20), and the flush solution evacuation port (25). As the coating solution leaves the hopper lip (16), it contacts the preflush land (22) which is the portion of the edge guide not flushed with flushing solution. The thickness of the land (22) is determined by the solution flow rate, viscosity and specific gravity of the coating liquid. The length of this land is minimized to reduce viscous drag. Leaving the land (22), the curtain comes into contact with the flush solution, which prevents the higher viscosity curtain solution from contacting the edge guide, as previously described. This significantly reduces the viscous drag exhibited on the coating solution. The preflush land of the present invention can be configured like the "infinite wall" which is the subject of commonly assigned U.S. patent application Ser. No. 07/775,676 and incorporated by reference herein.

The following theory is presented to explain the working of the present invention, however, the applicant is not bound by this theory. To form a stable curtain, the surface tension forces which cause the curtain to pull away from the edge guide referred to herein as curtain contractile force must be less than the opposing surface tension force components. FIG. 7 shows a cross-sectional view of a curtain (17) and a prior art attempt to minimize the edge guide surface area. The edge guide (50) has a diameter substantially less than the curtain thickness. The resultant surface tension components which oppose the curtain contractile force are very small (arrows 94) relative to the curtain contractile force (arrows 95) and therefore, the curtain stability is poor. Thus, a stable curtain cannot be formed. FIG. 8 shows the same cross-sectional view of a curtain (17) when used with the present invention. In this example the dual wires (20) of the present invention are spaced a distance apart to provide a meniscus (30) between the wires (20) and thereby provide an edge guide thickness (31) which approximates the curtain thickness. The two wire edge guide increases curtain stability in the following manner. The meniscus formed between the wires provides increased surface tension forces (arrows 90) to balance the contractile force (arrows 95) of the curtain by providing an additional surface. The edge guide thickness can be matched to the curtain thickness, maintaining uniform curtain thickness up to the edge guide and therefore maximizing curtain momentum up to the edge. Finally, the two wire edge guide significantly reduce the surface contact area between the edge guide and the curtain thereby reducing drag and increasing velocity of the curtain at the edge.

Spacing the wires (20) too far apart reduces the balancing force provided by the meniscus (30) and causes the curtain to transfer to one wire or the other. No spacing between the wires eliminates the meniscus and causes the curtain to be less stable and act as a single wire. Spacing the wires apart a distance comparable to the curtain thickness optimizes the widthwise edge uniformity by eliminating the formation of a large scale meniscus in the region shown by (32) in FIG. 11.. FIG. 9 shows the wide meniscus (33) formed on a prior art edge guide (51). In FIG. 9 the curtain (17) expands as it nears the edge guide (51) thus, the curtain (17) is wider at the edge than in the center. Contrasting FIG. 9 with FIG. 8 shows that the dual wires of the present invention form an edge guide which more closely matches the thickness of the curtain.

In addition, the anchoring of the curtain achieved with the dual wire rods of the present invention is superior to that shown with the prior art designs. FIG. 10 shows the curtain (17) and a prior art edge guide (51) and the displacement of the curtain (17*a*) due to curtain motion. Curtain motion can be caused by a pressure difference between the frontside and backside of the curtain. Because of the large area (60) of a thin film coating, coating material has a high propensity to congeal forming deposits. FIG. 11 shows a similar view for an edge guide of the present invention. In FIGS. 10 and 11 the displacement angle from the steady state curtain position is equal for both designs. However, the area of thin film coating produced by the small deviation from the steady state wetting line position, shown as (61), realized with the current invention shown in FIG. 11, is superior to the area of thin film coating produced by the deviation from the steady state wetting line position, shown as (60) in the prior art design shown in FIG. 10. Since a smaller area of the rods of the present invention is coated as a result of curtain motion when compared to prior art edge guides, the propensity for the formation of congealed deposits is much lower.

In a preferred embodiment of the present invention, the dual wires are approximately 0.005 inches in diameter. The distance between the outer edges of the wires approximates the thickness of the falling curtain which in typical cases is approximately 0.005 to about 0.020 inches. The dual wires form a plane which is approximately perpendicular to the plane of the falling curtain. The material for the dual wires can be almost any metal. The preferred material for the dual wires is tungsten. Other materials such as niobium or tantalum are also preferred. In a more preferred embodiment of the present invention, the distance between the wires is greater near the hopper and this distance lessens as the wires approach the support to approximate the thickness of the curtain, which thickness decreases with distance from the hopper lip. The distance between the wires is approximately 0.01 inches near the hopper and lessens to 0.008 inches near the support. The flush solution per edge guide ranges from approximately 1 cc/min to about 100 cc/min.

EXAMPLE 1

Using the dual wires as edge guides described above, a relatively high flow rate and high viscosity system was tested. Higher or lower flow rates than what are shown in these examples are possible and this does not define the upper or lower property limits of the present invention. Example 1 shows that the present invention coats well and also uses less flush solution than edge guides shown in Examples 2 and 3 of U.S. Pat. No. 4,830,887.

Viscosity: 60 cps
Curtain Flow Rate: 5.5 $cm^3$/cm/sec
Specific Gravity 1.03 g/$cm^3$
Surface Tension: 32 dynes/cm
Coating Speed: 411 meters/min
Curtain Height 25 cm
Application Point: +45° forward of top dead center
Flush Solution Flow Rate: 15 $cm^3$/min (One Edge of Curtain)
Flush Solution Viscosity: 0.65 cps
Evacuation Vacuum Level: 445 cm of $H_2O$

EXAMPLE 2

Example 2 shows the present invention used on a relatively low flow rate per unit width and low viscosity system.

Viscosity: 15 cps
Curtain Flow Rate: 1.3 $cm^3$/cm/sec
Specific Gravity 1.03 g/$cm^3$
Surface Tension: 32 dynes/cm
Coating Speed: 290 meters/min
Curtain Height 25 cm
Application Point: +25° forward of top dead center
Flush Solution Flow Rate: 30 $cm^3$/min
Flush Solution Viscosity: 0.7 cps
Evacuation Vacuum Level: 445 cm of $H_2O$

EXAMPLE 3

Example 3 shows the present invention works well for high viscosity, low flow rate conditions. In this Example no evacuation was provided as the outboard edging coating method was used.

Viscosity: 55 cps
Curtain Flow Rate: 1.3 $cm^3/cm/sec$
Specific Gravity 1.03 $g/cm^3$
Surface Tension: 32 dynes/cm
Coating Speed: 290 meters/min
Curtain Height 25 cm
Application Point: +25° forward of top dead center
Flush Solution Flow Rate: 30 $cm^3/min$
Flush Solution Viscosity: 0.7 cps The dual wires also ensure a precise curtain location and allows this apparatus to be employed in the edging method described by Reiter in U.S. Pat. No. 4,830,877 which requires the curtain to fall within close proximity to a vacuum evacuation port. Placing a vacuum evacuation port at the bottom of the edge guide ensures that the flushing solution is adequately removed from the curtain prior to coating, thereby forming a more uniform coating.

Figure 12:
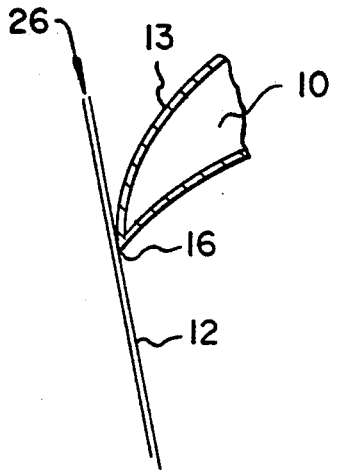
FIG. 12 shows a side view of an alternate embodiment of the present invention.

FIG. 12 shows an alternate embodiment of the present invention. FIG. 12 shows a side view of a slide hopper (10) in which coating solutions flow down the slide surface (13). The dual wire edge guide (12) of the present invention extends above the hopper lip (16) as shown in FIG. 12. In this embodiment the flushing solution is introduced at point (26). The solution flows between the wires and contacts the curtain at the hopper lip (16).

Figure 13:
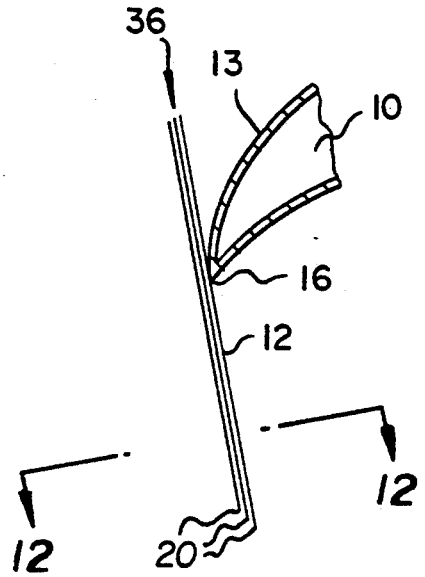
FIG. 13 shows a side view of another embodiment of the present invention.
Figure 14:
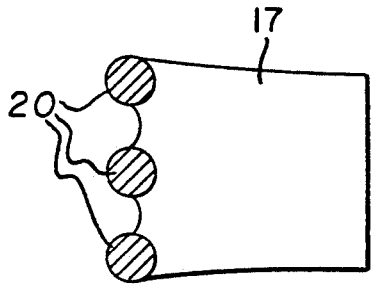
FIG. 14 shows a cross sectional view through line 12—12 of FIG. 13.

FIGS. 13 and 14 show another embodiment wherein three (3) wires are used as the edge guide (12). Although FIG. 14 shows that the three wires used as edge guide 12 are coplanar, it is not necessary that they be so. FIG. 13 shows that the flushing solution is added at point (36). However a preflush land as described previously could be used to introduce flushing solution below the hopper lip. The "infinite wall" of U.S. Ser. No. 07/775,676 could also be used as described previously.

When employing the inboard edging method of U.S. Pat. No. 4,830,877 one must remove all curtain and edge flushing solutions from between the edge guides prior to a coating start and after a coating finish, so as to avoid depositing unwanted materials onto the support. There are two reasons for avoiding premature coating materials from falling onto the support. The first is that the support preceding and following the coating is typically a leader material which will be reused, and may not perform properly if it has been coated. The second is that inadvertent spillage onto the support may result in a coating which is greater in thickness than the dryer's drying capability, thereby causing transfer of material to subsequent transport rollers or possible sticking of wrapped layers on the wound roll. U.S. Pat. No. 5,017,408 to Kozak, describes a method and apparatus used to remove the curtain solution prior to coating. In this patent a catchpan is employed with flexible material at the pan edges which when brought into contact with the edge guide scrapes the curtain and edge flushing solutions from the edge guide and directs them into the catchpan. The current invention has been tested with this coating start apparatus and has performed similar to the prior art, thereby showing that the present invention can be used in conjunction with state of the art start/finish technology.

While there has been shown and described what are at present considered the preferred embodiments of the present invention, it will be obvious to those skilled in the art that various alterations and modifications may be made therein without departing from the scope of the invention.

What is claimed:

1. A method of curtain coating a support with one layer of a liquid coating composition comprising:

moving a support along a path through a coating zone;

forming one or more layers of coating liquids to form a liquid coating composition;

forming a free falling curtain from said liquid coating composition within said coating zone which extends transversely to said path and impinges on said moving support;

laterally guiding said falling curtain by edge guides each of said edge guides having two or more wires extending from a point of formation of the falling curtain to the support, said two or more wires spaced apart a distance approximately equal to a thickness of the falling curtain; and providing a flushing means which contacts an edge region of said falling curtain and said two or more wires.

2. The method according to claim 1 further comprising:

extracting liquids from the edge region of said falling curtain by a vacuum source near the impingement of said falling curtain on said support.

3. An apparatus for curtain coating a support with one or more layers of a coating liquid comprising:

means for moving said support along a path through a coating zone;

means for forming one or more layers of coating liquid to form a free falling curtain which extends transversely to said path and impinges on said support;

edge guides, spaced apart a distance for laterally guiding said falling curtain, each of said edge guides comprising:

a pair of wires spaced apart a distance, the distance being approximately equal to the thickness of the curtain, said pair of wires extending from forming means to the support; and flushing means for issuing a flushing solution near a top of each of said edge guides to maintain contact with said pair of wires and a main body of the curtain.

4. The apparatus according to claim 3 further comprising:

suction means for extracting said flushing solution from an edge region of the falling curtain near the impingement of said falling curtain on said support.

5. The apparatus according to claim 3 wherein the diameter of each of the wires of said pair is approximately 0.005 inches.

6. The apparatus according to claim 3 wherein said distance is from approximately 0.005 inches to about 0.020 inches.

7. The apparatus according to claim 3 wherein said distance is approximately 0.010 inches at the top of each edge guide and approximately 0.008 inches near the impingement of said curtain on said support.

8. The apparatus according to claim 3 wherein said flushing solution has a flow rate of approximately 1 cc/min to about 100 cc/min.

9. An apparatus for laterally guiding a falling curtain to a support comprising:

at least one guide extending from a top of the falling curtain to the support said at least one edge guide formed from two or more wires spaced apart a distance, the distance being approximately equal to a thickness of the curtain; and flushing means for issuing a solution near a top of said at least one edge guide, the flushing solution maintaining wetting contact with the wires and a main body of the curtain.

10. The apparatus according to claim 9 further comprising:

suction means for extracting said flushing solution from an edge region of the falling curtain near a bottom of said at least one edge guide.

11. The apparatus according to claim 9 wherein the diameter of each of the two or more wires is approximately 0.005 inches.

12. The apparatus according to claim 9 wherein said distance is from approximately 0.005 inches to about 0.020 inches.

13. The apparatus according to claim 9 wherein said distance is approximately 0.010 inches near the top of the falling curtain and approximately 0.008 inches near the support.

14. The apparatus according to claim 9 wherein said flushing solution has a flow rate of approximately 1 cc/min to about 100 cc/min.

15. An apparatus for curtain coating a support with one or more layers of a coating liquid comprising:

means for moving said support along a path through a coating zone;

means for forming one or more layers of coating liquid to form a free falling curtain which extends transversely to said path and impinges on said support;

edge guides spaced apart a distance for laterally guiding said falling curtain each of said edge guides comprising:

a solid land positioned at a bottom of said means for forming;

flushing means for issuing a flushing solution at a bottom of said solid land;

a pair of wires extending from the bottom of said solid land to a point of impingement on the support, said pair of wires spaced apart a distance, the distance being approximately equal to the thickness of the curtain wherein said flushing solution is in contact with said pair of wires and an edge region of said falling curtain; and suction means for extracting said flushing solution from said edge region of said falling curtain near the impingement of said falling curtain on said support.

16. The apparatus according to claim 15 wherein the diameter of each of the wires of said pair is approximately 0.005 inches.

17. The apparatus according to claim 15 wherein said distance is from approximately 0.005 inches to about 0.020 inches.

18. The apparatus according to claim 15 wherein said distance is approximately 0.010 inches at the bottom of said solid land and approximately 0.008 inches at the impingement of the falling curtain on said support.

19. The apparatus according to claim 15 wherein said flushing solution has a flow rate of approximately 1 cc/min to about 100 cc/min.

20. An apparatus for laterally guiding a falling curtain to a support comprising:

at least one edge guide extending from a top of the falling curtain to the support said at least one edge guide comprising:

a solid land positioned near the top of the falling curtain;

flushing means for issuing a flushing solution at a bottom of said solid land; and two or more wires extending from the bottom of said solid land to the support, said two or more wires spaced apart a distance, said distance being approximately equal to the thickness of the falling curtain wherein an edge region of said curtain contacts said solid land and then contacts the flushing solution, the flushing solution contacting said pair of wires.

21. The apparatus according to claim 20 further comprising:

suction means for extracting said flushing solution from the edge region of the falling curtain near the support.

22. The apparatus according to claim 20 wherein the diameter of each of the two or more wires is approximately 0.005 inches.

23. The apparatus according to claim 20 wherein said distance is from approximately 0.005 inches to about 0.020 inches.

24. The apparatus according to claim 20 wherein said distance is approximately 0.010 inches at the solid land and approximately 0.008 inches at the support.

25. The apparatus according to claim 20 wherein said flushing solution has a flow rate of approximately 1 cc/min to about 100 cc/min.

* * * * *